US009586774B2

(12) United States Patent
Mine et al.

(10) Patent No.: US 9,586,774 B2
(45) Date of Patent: Mar. 7, 2017

(54) SHEET FEEDING MEMBER

(71) Applicant: SUMITOMO RUBBER INDUSTRIES, LTD., Kobe-shi, Hyogo (JP)

(72) Inventors: Akihiro Mine, Kobe (JP); Toshihiro Tamura, Kobe (JP); Takehiko Hyodo, Kobe (JP)

(73) Assignee: SUMITOMO RUBBER INDUSTRIES, LTD., Kobe-Shi (JP)

( * ) Notice: Subject to any disclaimer, the term of this patent is extended or adjusted under 35 U.S.C. 154(b) by 410 days.

(21) Appl. No.: 14/148,405

(22) Filed: Jan. 6, 2014

(65) Prior Publication Data

US 2014/0203497 A1 Jul. 24, 2014

(30) Foreign Application Priority Data

Jan. 23, 2013 (JP) ..... 2013-010241

(51) Int. Cl.
*B65H 3/06* (2006.01)
*B65H 3/52* (2006.01)

(52) U.S. Cl.
CPC ..... *B65H 3/0638* (2013.01); *B65H 3/52* (2013.01); *B65H 2401/111* (2013.01); *B65H 2401/212* (2013.01)

(58) Field of Classification Search
CPC ..... B65H 2401/111; B65H 2401/112; B65H 3/0638
See application file for complete search history.

(56) References Cited

U.S. PATENT DOCUMENTS

| | | | | |
|---|---|---|---|---|
| 5,454,559 | A * | 10/1995 | Murakami | B65H 3/5223 271/264 |
| 7,367,554 | B2 * | 5/2008 | Mine | B65H 3/5223 271/104 |
| 2002/0037990 | A1 * | 3/2002 | Hitoshi | B65H 3/5223 528/80 |
| 2005/0230904 | A1 * | 10/2005 | Mine | B65H 3/5223 271/121 |

FOREIGN PATENT DOCUMENTS

| | | | |
|---|---|---|---|
| JP | 9-175670 | A | 7/1997 |
| JP | 2002-255386 | A | 9/2002 |
| JP | 2002255386 | A * | 9/2002 |
| JP | 2008-13295 | A | 1/2008 |
| JP | 2011-84394 | A | 4/2011 |

OTHER PUBLICATIONS

English Translation of JP 2002255386 A.*

* cited by examiner

*Primary Examiner* — Jacob Cigna
(74) *Attorney, Agent, or Firm* — Birch, Stewart, Kolasch & Birch, LLP

(57) ABSTRACT

A sheet feeding member is provided, which is made of a thermoplastic elastomer composition comprising: a base polymer including a polyurethane thermoplastic elastomer and a polyester thermoplastic elastomer; and at least one ion conductive agent selected from the group consisting of a quaternary ammonium salt and a lithium salt/polyol, wherein the ion conductive agent is present in a proportion of 0.2 to 4 parts by mass based on 100 parts by mass of the base polymer in the thermoplastic elastomer composition.

9 Claims, No Drawings

SHEET FEEDING MEMBER

TECHNICAL FIELD

The present invention relates to a sheet feeding member such as a separation pad or a sheet feed roller to be incorporated in an image forming apparatus such as a laser printer.

BACKGROUND ART

In an image forming apparatus such as a laser printer, an electrostatic copying machine, a plain paper facsimile machine or a printer-copier-facsimile multifunction machine, a separation pad is generally used for separating and feeding out a sheet from a stack of sheets contained in a sheet feed cassette or a sheet feed tray (the term "sheet" is herein defined to include a paper sheet, a plastic film such as an OHP film and the like, and this definition is effective in the following description). Further, a sheet feed roller for feeding the sheet and a registration roller for registering a leading edge of the sheet and feeding out the sheet at predetermined timing are used in combination with the separation pad.

Sheet feeding members including the separation pad, the sheet feed roller and the like are conventionally produced by forming a rubber composition containing a crosslinkable rubber into a predetermined shape and crosslinking the rubber (Patent Literature 1).

In recent years, however, it has been required to use a thermoplastic elastomer for the production of the sheet feeding members because the thermoplastic elastomer has a thermoplastic property and hence is easy to recycle (Patent Literature 2).

To meet recent requirements for size reduction and cost reduction of the laser printer and the like, the construction of a sheet feeding mechanism itself is simplified with the need for reduction in the number of parts.

In the conventional sheet feeding mechanism, a sheet is separated and fed out from the stack of sheets contained in the sheet feed cassette or the like by the separation pad and the sheet feed roller, and then transported to an image forming section through the registration roller, a sheet transport roller, an anti-static brush and the like.

In the conventional sheet feeding mechanism, therefore, the separation pad is repeatedly rubbed against sheets to be electrically charged, and the accumulated electric charges are often released to the sheet, which is in turn electrically charged. However, the electric charges are removed from the sheet when the sheet is transported along a transportation path provided with the various rollers before reaching the image forming section. Therefore, the image formation is not influenced by the electric charges.

In an image forming apparatus having the simplified sheet feeding mechanism, however, the electric charges are not sufficiently removed from the sheet, so that the sheet is fed into the image forming section in a charged state. This frequently results in formation of a disturbed image.

In order to prevent the formation of a disturbed image, it is desirable to produce the separation pad from a material such that the surface potential of the separation pad can be maintained at a lower level even if the surface of the separation pad is repeatedly brought into contact with sheets to be rubbed against the sheets.

In the present invention, the surface potential is expressed as a value determined by the following measurement. A surface of a separation pad forming material is electrically charged in an ordinary temperature and ordinary humidity environment at a temperature of 23° C. at a relative humidity of 50% by reciprocating the separation pad forming material for a distance of 30 mm at a speed of 3000 mm/min 30 times with the surface of the separation pad forming material kept in contact with a proper bond paper sheet (Canon's PB PAPER) with a load of 1.96 N by means of a surface state analyzer (TRIBOGEAR (registered trade name) HEIDON (registered trade name) 14DR available from Shinto Scientific Co., Ltd.), and then the surface potential of the separation pad forming material is measured by means of a compact surface potentiometer (KASUGA KD-103 available from Kasuga Electric Works Ltd.)

PRIOR ART LITERATURE

Patent Literature

Patent Literature 1: JP2002-255386A
Patent Literature 2: JP2011-84394A

SUMMARY OF INVENTION

Problems to be Solved by the Invention

In Patent Literature 2, it is stated that a polyurethane thermoplastic elastomer and a polyester thermoplastic elastomer are used in combination as a material for the separation pad.

In general, a separation pad made of the polyurethane thermoplastic elastomer alone is negatively charged when being brought into contact with a sheet. On the other hand, a separation pad made of the polyester thermoplastic elastomer alone is positively charged when being brought into contact with a sheet.

Even if these two types of thermoplastic elastomers are used in combination, it is impossible to significantly reduce the surface potential with the positive and negative charges balanced. The surface potential is reduced to some extent, but the surface of the separation pad is either positively or negatively charged based on the proportions of the thermoplastic elastomers and the distribution structure of the thermoplastic elastomers.

The two types of thermoplastic elastomers are immiscible with each other and, therefore, form a so-called sea-island structure which includes a sea component made of either one of the thermoplastic elastomers and an island component made of the other thermoplastic elastomer and distributed in the sea component. In this case, the sea component and the island component are determined by the proportions of the two types of thermoplastic elastomers, and the separation pad is electrically charged to the charge polarity of the one thermoplastic elastomer defining the sea component.

As a result, a disturbed image is formed.

This problem is associated not only with the separation pad but also with the sheet feed roller to be used in combination with the separation pad.

It is an object of the present invention to provide a sheet feeding member such as a separation pad or a sheet feed roller, which is free from the formation of a disturbed image with its surface potential maintained at a lower level even if being repeatedly rubbed against sheets.

Solution to Problem

A sheet feeding member according to the present invention comprises a thermoplastic elastomer composition which comprises: a base polymer including a polyurethane thermoplastic elastomer and a polyester thermoplastic elastomer; and at least one ion conductive agent selected from the group consisting of a quaternary ammonium salt and a lithium salt/polyol, wherein the ion conductive agent is present in a proportion of not less than 0.2 parts by mass and not greater than 4 parts by mass based on 100 parts by mass of the base polymer in the thermoplastic elastomer composition.

According to the present invention, the polyurethane thermoplastic elastomer and the polyester thermoplastic elastomer, which have opposite charge polarities, are used in combination. This suppresses electrification of the sheet feeding member to some extent when the sheet feeding member is repeatedly rubbed against sheets.

The at least one ion conductive agent selected from the group consisting of the quaternary ammonium salt and the lithium salt/polyol is blended in the predetermined proportion with the base polymer including the two types of thermoplastic elastomers, whereby the sheet feeding member is imparted with excellent ion conductivity. Thus, even if the sheet feeding member is repeatedly rubbed against the sheets to be thereby electrically charged, electric charges can be immediately released from the sheet feeding member.

Therefore, the surface potential of the sheet feeding member can be minimized, thereby preventing the accumulation of the electric charges on the sheet feeding member. Thus, the formation of a disturbed image can be reliably prevented, which may otherwise occur when the accumulated electric charges are released from the sheet feeding member to electrically charge a sheet.

In Patent Literature 1, it is stated that an ion conductive agent and/or a carbon black electron conductive agent are blended with a rubber as a material for the separation pad. This aims at preventing adhesion of paper dust to the separation pad. In Patent Literature 1, no consideration is given to the reduction of the surface potential of the separation pad when the separation pad is repeatedly rubbed against sheets.

Actually, the surface potential of the separation pad cannot be reduced by the combinational use of the rubber and the ion conducive agent described in Patent Literature 1.

In the present invention, the proportion of the ion conductive agent to be blended is limited to the range of not less than 0.2 parts by mass and not greater than 4 parts by mass based on 100 parts by mass of the base polymer for the following reason.

If the proportion of the ion conductive agent is less than the aforementioned range, it will be impossible to provide the effect of imparting the sheet feeding member with excellent ion conductivity to reduce the surface potential of the sheet feeding member by the blending of the ion conductive agent. If the proportion of the ion conductive agent is greater than the aforementioned range, the surface potential reducing effect is not improved. In addition, the proportion of the base polymer is relatively reduced, so that the sheet feeding member is deteriorated in abrasion resistance.

Where the proportion of the ion conductive agent is within the aforementioned range, on the other hand, it is possible to impart the sheet feeding member with excellent ion conductivity to minimize the surface potential of the sheet feeding member and to impart the sheet feeding member with excellent abrasion resistance.

For further improvement of this effect, the proportion of the ion conductive agent is preferably not greater than 1 part by mass based on 100 parts by mass of the base polymer.

The inventive sheet feeding member is applicable to a separation pad for separating and feeding out a sheet from a stack of sheets contained in a sheet feed cassette or a sheet feed tray of an image forming apparatus as described above, and to a sheet feed roller to be used in combination with the separation pad for feeding out the sheet.

Effects of Invention

The present invention provides a sheet feeding member such as a separation pad or a sheet feed roller, which is capable of maintaining its surface potential at a lower level even if being repeatedly rubbed against sheets.

DESCRIPTION OF EMBODIMENTS

The inventive sheet feeding member is made of a thermoplastic elastomer composition which contains a base polymer including a polyurethane thermoplastic elastomer and a polyester thermoplastic elastomer, and at least one ion conductive agent selected from the group consisting of a quaternary ammonium salt and a lithium salt/polyol. In the thermoplastic elastomer composition, the ion conductive agent is present in a proportion of not less than 0.2 parts by mass and not greater than 4 parts by mass based on 100 parts by mass of the base polymer.

<Base Polymer>

Examples of the polyurethane thermoplastic elastomer include various polyurethane thermoplastic elastomers each including a hard segment having a polyurethane structure and a soft segment having a polyester or polyether structure. These polyurethane thermoplastic elastomers may be used either alone or in combination.

Specific examples of the polyurethane thermoplastic elastomer include ELASTORAN (registered trade name) series C80A, C85A, 1180A, ET385, ET880 and ET885 available from BASF Co., Ltd., which may be used either alone or in combination.

Examples of the polyester thermoplastic elastomer include various polyester thermoplastic elastomers such as multi-block polymers which each include a hard segment of an aromatic polyester (e.g., polybutylene terephthalate) having a higher melting point and a higher crystallinity and a soft segment of an amorphous polyether (e.g., polytetramethylene ether glycol) having a glass transition temperature of not higher than about −70° C. These polyester thermoplastic elastomers may be used either alone or in combination.

Specific examples of the polyester thermoplastic elastomers include HYTREL (registered trade name) series 3046, G3548L and 3078 available from Toray Du Pont Co., Ltd., which may be used either alone or in combination.

The combinational use of two types of thermoplastic elastomers having opposite charge polarities makes it possible to suppress the electrification of the sheet feeding member to some extend when the sheet feeding member is repeatedly rubbed against sheets. Further, the combinational use improves the abrasion resistance of the sheet feeding member as described in Patent Literature 2, and improves a multiple-sheet feeding preventing effect and a squeal preventing effect, for example, when the sheet feeding member is used as a separation pad.

For improvement of the effects of the combinational use of the two types of thermoplastic elastomers, the proportion of the polyurethane thermoplastic elastomer is preferably not less than 5 mass % and not greater than 90 mass %, more preferably not less than 20 mass % and not greater than 80 mass %, particularly preferably not less than 40 mass % and not greater than 60 mass %, based on the total amount of the two types of thermoplastic elastomers.

If the proportion of the polyurethane thermoplastic elastomer is less than the aforementioned range, the positive chargeability of the sheet feeding member is liable to be increased, so that the surface potential reducing effect is insufficient. Further, the abrasion resistance is liable to be reduced, and the multiple-sheet feeding preventing effect is liable to be reduced when the sheet feeding member is used as the separation pad.

If the proportion of the polyurethane thermoplastic elastomer is greater than the aforementioned range, the negative chargeability of the sheet feeding member is liable to be increased, so that the surface potential reducing effect is insufficient. Further, the squeal preventing effect is liable to be reduced when the sheet feeding member is used as the separation pad.

<Ion Conductive Agent>

The quaternary ammonium salt to be used as the ion conductive agent may be supplied, for example, in the form of a master batch containing the quaternary ammonium salt dispersed in the polyurethane thermoplastic elastomer.

A specific example of the quaternary ammonium salt to be supplied in the form of the master batch is SB MASTERBATCH available from BASF Co., Ltd.

Examples of the lithium salt/polyol include lithium complexes prepared by dissolving a lithium salt in a polyol and coordinating lithium ions ($Li^+$) in the polyol. These lithium complexes may be used either alone or in combination.

A specific example of the lithium salt/polyol is SANKONOL (registered trade name) PEO-20R available from Toei Chemical Co., Ltd.

The proportion of the ion conductive agent should be not less than 0.2 parts by mass and not greater than 4 parts by mass based on 100 parts by mass of the base polymer including the polyurethane thermoplastic elastomer and the polyester thermoplastic elastomer.

If the proportion of the ion conductive agent is less than the aforementioned range, it will be impossible to provide the aforementioned effect of imparting the sheet feeding member with excellent ion conductivity to reduce the surface potential of the sheet feeding member by the blending of the ion conductive agent. If the proportion of the ion conductive agent is greater than the aforementioned range, it will be impossible to provide the aforementioned effect. In addition, the proportion of the base polymer is relatively reduced to deteriorate the abrasion resistance of the sheet feeding member.

Where the proportion of the ion conductive agent is within the aforementioned range, on the other hand, it is possible to impart the sheet feeding member with excellent ion conductivity to minimize the surface potential and to impart the sheet feeding member with excellent abrasion resistance.

For further improvement of this effect, the proportion of the ion conductive agent is preferably not greater than 1 part by mass, particularly not greater than 0.6 parts by mass, based on 100 parts by mass of the base polymer.

Where the ion conductive agent is used in the form of the master batch, the aforementioned proportion of the ion conductive agent is based on the effective amount of the quaternary ammonium salt contained in the master batch based on 100 parts by mass of the base polymer. In this case, the amount of the polyurethane thermoplastic elastomer contained together with the quaternary ammonium salt in the master batch is additionally counted in the proportion of the base polymer.

<Filler>

A filler may be blended in the thermoplastic elastomer composition for controlling the rubber hardness and the like of the sheet feeding member. Examples of the filler include carbon black, silica, calcium carbonate and talc, which may be used either alone or in combination.

The proportion of the filler is preferably not less than 0.5 parts by mass and not greater than 2 parts by mass based on 100 parts by mass of the base polymer.

<Sheet Feeding Member>

The inventive sheet feeding member may be, for example, a separation pad or a sheet feed roller.

The separation pad is produced by forming the thermoplastic elastomer composition into a planar shape. The sheet feed roller is produced by forming the thermoplastic elastomer composition into a tubular body and inserting a shaft such as of a metal or a hard plastic material into the inside of the tubular body to unify the shaft and the tubular body.

The sheet feeding member preferably has a surface potential of not less than −0.4 kV and not greater than +0.4 kV as measured in the ordinary temperature and ordinary humidity environment at a temperature of 23° C. at a relative humidity of 50% by the aforementioned measurement method.

If the surface potential falls outside the aforementioned range, the sheet feeding member is liable to suffer from the accumulation of electric charges when being repeatedly rubbed against sheets. This may result in the formation of a disturbed image when the electric charges are released from the sheet feeding member to a sheet. Where the surface potential falls within the aforementioned range, on the other hand, the accumulation of the electric charges is prevented, thereby reliably preventing the release of the electric charges and the formation of a disturbed image.

Where the sheet feeding member is the separation pad, a surface of the separation pad to be brought into contact with sheets preferably has a rubber hardness (JIS-A hardness) of not less than 70 and not greater than 95 as measured in the ordinary temperature and ordinary humidity environment by a measurement method specified in the Japanese Industrial Standards JIS K6253:2006 "Rubber, vulcanized or thermoplastic—Determination of hardness—Part 3: Durometer method."

If the JIS-A hardness of the separation pad is less than the aforementioned range, the separation pad is liable to have an insufficient abrasion resistance and hence have an uneven surface due to abrasion, thereby suffering from a so-called sheet feeding failure in which sheets cannot be smoothly fed out at a constant speed from a sheet feed cassette or a sheet feed tray. If the JIS-A hardness of the separation pad is greater than the aforementioned range, the separation pad is liable to have a reduced friction coefficient, thereby suffering from a so-called multiple-sheet feeding phenomenon in which a sheet cannot be properly separated from a stack of sheets contained in the sheet feed cassette or the sheet feed tray and two or more sheets are fed out together in an overlapping state.

The separation pad preferably has a friction coefficient of not less than 0.6 and not greater than 1.4, particularly preferably not less than 0.7 and not greater than 1.2 as measured with respect to a proper bond paper sheet (Canon's PB PAPER) by means of a surface state analyzer (TRIBOGEAR (registered trade name) HEIDON (registered trade name) 14DR available from Shinto Scientific Co., Ltd. as described above) in the ordinary temperature and ordinary humidity environment.

If the friction coefficient is less than the aforementioned range, the multiple-sheet feeding phenomenon is liable to occur. If the friction coefficient is greater than the aforementioned range, a so-called no-sheet feeding phenomenon is liable to occur in which no sheet is fed out from the sheet feed cassette or the sheet feed tray.

Conditions for the measurement of the friction coefficient are a separation pad plan size of 10 mm×30 mm, a load of 1.96 N and a speed of 600 mm/min.

The separation pad preferably has an abrasion loss of not greater than 18 mg which is defined as a difference between masses of the separation pad measured in the ordinary temperature and ordinary humidity environment before and after 3000 PPC sheets are sequentially fed out by the separation pad in a commercially available monochromic laser printer (using a positively chargeable non-magnetic single-component toner, and a toner-specific recommended printable number of about 7000) in which the separation pad is mounted instead of an original separation pad.

If the abrasion loss is greater than the aforementioned range, the separation pad is liable to have an uneven surface due to abrasion, thereby suffering from the sheet feeding failure. Needless to say, the lower limit of the abrasion loss is 0 mg.

EXAMPLES

Example 1

A thermoplastic elastomer composition was prepared by blending 0.5 parts by mass of an ion conductive agent of a quaternary ammonium salt and 1 part by mass of carbon black (SEAST SO available from Tokai Carbon Co., Ltd.) with a base rubber including 50 parts by mass of a polyurethane thermoplastic elastomer (ELASTORAN (registered trade name) ET880 available from BASF Co., Ltd.) and 50 parts by mass of a polyester thermoplastic elastomer (HYTREL (registered trade name) 3046 available from Toray Du Pont Co., Ltd.), and kneading the resulting mixture by means of a twin screw extruder. The thermoplastic elastomer composition was extruded into a sheet having a thickness of 1.35 mm by means of a single screw extruder. Then, the sheet was cut into a rectangular shape, and the surface of the sheet was polished. Thus, a separation pad having a thickness of 1.0 mm and a rectangular planar shape was produced.

The quaternary ammonium salt was blended in the form of a master batch (BASF's SB MASTERBATCH) containing the quaternary ammonium salt dispersed in a polyurethane thermoplastic elastomer. The proportion of the master batch to be blended in the thermoplastic elastomer composition was properly adjusted so that the proportion of the quaternary ammonium salt present as the effective component in the thermoplastic elastomer composition was 0.5 parts by mass based on 100 parts by mass of the base polymer and the proportion of the polyurethane thermoplastic elastomer for the base polymer including the polyurethane thermoplastic elastomer contained in the master batch was 50 parts by mass based on 100 parts by mass of the base polymer.

Examples 2 and 3, and Comparative Examples 1 and 2

Separation pads each having the same shape and the same dimensions were produced in substantially the same manner as in Example 1, except that the proportion of the master batch and the proportion of the polyurethane thermoplastic elastomer for the base polymer were properly adjusted so that the proportion of the quaternary ammonium salt was 0.1 part by mass (Comparative Example 1), 2 parts by mass (Example 2), 4 parts by mass (Example 3) and 5 parts by mass (Comparative Example 2) based on 100 parts by mass of the base polymer.

Example 4

A separation pad having the same shape and the same dimensions was produced in substantially the same manner as in Example 1, except that a lithium salt/polyol (SANKONOL (registered trade name) PEO-20R available form Toei Chemical Co., Ltd.) was blended instead of the quaternary ammonium salt in a proportion of 0.5 parts by mass based on 100 parts by mass of the base polymer.

Comparative Example 3

A separation pad having the same shape and the same dimensions was produced in substantially the same manner as in Example 1, except that the quaternary ammonium salt was not blended.

Comparative Example 4

A separation pad having the same shape and the same dimensions was produced in substantially the same manner as in Example 1, except that 100 parts by mass of the polyurethane thermoplastic elastomer was blended alone as the base polymer and the quaternary ammonium salt was not blended.

Comparative Example 5

A separation pad having the same shape and the same dimensions was produced in substantially the same manner as in Example 1, except that 100 parts by mass of the polyester thermoplastic elastomer was blended alone as the base polymer and the quaternary ammonium salt was not blended.

<Measurement of Rubber Hardness>

The JIS-A hardness of a surface of each of the separation pads of Examples and Comparative Examples to be brought into contact with a sheet was measured in the ordinary temperature and ordinary humidity environment by the measurement method specified in the Japanese Industrial Standards JIS K6253:2006 "Rubber, vulcanized or thermoplastic—Determination of hardness—Part 3: Durometer method."

<Measurement of Friction Coefficient>

The friction coefficient of a surface of each of the separation pads of Examples and Comparative Examples to be brought into contact with a sheet was measured with respect to a proper bond paper sheet (Canon's PB PAPER) by means of the surface state analyzer (TRIBOGEAR HEIDON-14DR available from Shinto Scientific Co., Ltd. described above) in the ordinary temperature and ordinary humidity environment.

<Measurement of Surface Potential>

The surface potential (kV) of each of the separation pads of Examples and Comparative Examples was measured in the ordinary temperature and ordinary humidity environment by means of the compact surface potentiometer (KASUGA KD-103 available from Kasuga Electric Works Ltd.)

after the surface of the separation pad was electrically charged by reciprocating the separation pad for a distance of 30 mm at a speed of 3000 mm/min 30 times with the surface of the separation pad kept in contact with a proper bond paper sheet (Canon's PB PAPER) with a load of 1.96 N by means of the surface state analyzer (TRIBOGEAR (registered trade name) HEIDON (registered trade name) 14DR available from Shinto Scientific Co., Ltd.) A separation pad having a surface potential in a range of not less than −0.4 kV and not greater than +0.4 kV is rated as acceptable, and a separation pad having a surface potential falling outside this range is rated as unacceptable.

<Abrasion Resistance Test>

The separation pads of Examples and Comparative Examples were each mounted instead of an original separation pad in a commercially available monochromic laser printer (using a positively chargeable non-magnetic single-component toner, and having a toner-specific recommended printable number of about 7000). Then, the abrasion loss (mg) of the separation pad was determined as a difference between masses of the separation pad measured in the ordinary temperature and ordinary humidity environment before and after 3000 PPC sheets were sequentially fed out by the separation pad.

<Evaluation Against Multiple-Sheet Feeding>

During the abrasion resistance test, the number of times of occurrence of the multiple-sheet feeding phenomenon (in which two or more PPC sheets were fed out) was counted, and the separation pad was evaluated for the multiple-sheet feeding preventing effect based on the following criteria:

○: No multiple-sheet feeding occurred

Δ: The multiple-sheet feeding occurred once to four times.

x: The multiple-sheet feeding occurred five or more times.

<Evaluation Against Squeal>

During the abrasion resistance test, the separation pad was checked for squeal, and evaluated for the squeal preventing effect based on the following criteria:

○: No squeal occurred, or slight acceptable squeal occurred.

Δ: The squeal occurred once in a while.

x: The squeal frequently occurred.

<Evaluation for Formed Image>

The separation pads of Examples and Comparative Examples were each mounted instead of an original separation pad in a commercially available monochromic laser printer (using a positively chargeable non-magnetic single-component toner, and having a toner-specific recommended printable number of about 7000). In the ordinary temperature and ordinary humidity environment, an image was printed at a printing percentage of 1% on 100 paper sheets, and a half-tone image was printed on the 101st paper sheet. The half-tone image was visually inspected.

x: A disturbed image was formed with ZIP roughness or white dots.

○: A formed image was free from disturbance without ZIP roughness and white dots.

The results are shown in Tables 1 and 2. In Tables 1 and 2, "TPU" indicates the polyurethane thermoplastic elastomer, and "TPEE" indicates the polyester thermoplastic elastomer.

TABLE 1

| | Comparative Example 1 | Example 1 | Example 2 | Example 3 | Comparative Example 2 |
|---|---|---|---|---|---|
| Parts by mass | | | | | |
| TPU | 50 | 50 | 50 | 50 | 50 |
| TPEE | 50 | 50 | 50 | 50 | 50 |
| Quaternary ammonium salt | 0.1 | 0.5 | 2 | 4 | 5 |
| Lithium salt/polyol | — | — | — | — | — |
| Carbon black | 1 | 1 | 1 | 1 | 1 |
| Evaluation | | | | | |
| JIS-A hardness | 83 | 83 | 82 | 81 | 79 |
| Friction coefficient | 1.0 | 1.1 | 1.2 | 1.2 | 1.4 |
| Surface potential (kV) | −0.6 | −0.2 | −0.1 | −0.1 | 0 |
| Abrasion loss (mg) | 8.2 | 8.3 | 10.0 | 13.0 | 20.0 |
| Multiple-sheet feeding | ○ | ○ | ○ | ○ | ○ |
| Squeal | ○ | ○ | ○ | ○ | ○ |
| Formed image | x | ○ | ○ | ○ | ○ |

TABLE 2

| | Example 4 | Comparative Example 3 | Comparative Example 4 | Comparative Example 5 |
|---|---|---|---|---|
| Parts by mass | | | | |
| TPU | 50 | 50 | 100 | — |
| TPEE | 50 | 50 | — | 100 |
| Quaternary ammonium salt | — | — | — | — |
| Lithium salt/polyol | 0.5 | — | — | — |
| Carbon black | 1 | 1 | 1 | 1 |
| Evaluation | | | | |
| JIS-A hardness | 81 | 77 | 80 | 85 |
| Friction coefficient | 1.2 | 1.0 | 0.8 | 0.9 |
| Surface potential (kV) | −0.1 | −0.8 | −1.1 | +1.3 |
| Abrasion loss (mg) | 7.9 | 8.1 | 18.0 | 4.2 |
| Multiple-sheet feeding | ○ | ○ | Δ | ○ |
| Squeal | ○ | ○ | ○ | Δ |
| Formed image | ○ | x | x | x |

The results for Comparative Examples 3 to 5 shown in Table 2 indicate that, where the polyurethane thermoplastic elastomer is used alone as the base polymer, the separation pad is significantly negatively charged and, where the polyester thermoplastic elastomer is used alone as the base polymer, the separation pad is significantly positively charged. In either case, a disturbed image is formed. Even if the two types of thermoplastic elastomers are used in combination, the negative and positive electric charges are not balanced but, as in Comparative Example 3, the separation pad is significantly negatively charged, resulting in the formation of a disturbed image.

In contrast, the results for Examples 1 to 4 shown in Tables 1 and 2 indicate that, where the quaternary ammonium salt or the lithium salt/polyol is blended as the ion conductive agent in the base polymer including the two types of thermoplastic elastomers, it is possible to impart the separation pad with excellent ion conductivity to significantly reduce the surface potential and to prevent the formation of a disturbed image.

The results for Examples 1 to 4 and Comparative Example 1 indicate that the proportion of the ion conductive agent should be not less than 0.2 parts by mass based on 100 parts by mass of the base polymer in order to provide the aforementioned effects.

The results for Examples 1 to 4 and Comparative Example 2 indicate that the proportion of the ion conductive agent should be not greater than 4 parts by mass, preferably not greater than 1 part by mass, based on 100 parts by mass of the base polymer in order to prevent the reduction in the abrasion resistance of the sheet feeding member while providing the aforementioned effects.

The results for Examples 1 and 4 indicate that the quaternary ammonium slat and the lithium salt/polyol have comparable effects as the ion conductive agent.

This application corresponds to Japanese Patent Application No. 2013-010241 filed in the Japan Patent Office on Jan. 23, 2013, the disclosure of which is incorporated herein by reference in its entirety.

What is claimed is:

1. A sheet feeding member comprising a thermoplastic elastomer composition which comprises:

a base polymer including 40 to 60 parts by mass of a polyurethane thermoplastic elastomer and 60 to 40 parts by mass of a polyester thermoplastic elastomer; and at least one ion conductive agent selected from the group consisting of a quaternary ammonium salt and a lithium salt/polyol, wherein the ion conductive agent is present in a proportion of not less than 0.2 parts by mass and not greater than 4 parts by mass based on 100 parts by mass of the base polymer in the thermoplastic elastomer composition.

2. The sheet feeding member according to claim 1, which is a sheet feed roller.

3. The sheet feeding member according to claim 1, wherein the proportion of the ion conductive agent is not greater than 1 part by mass based on 100 parts by mass of the base polymer.

4. The sheet feeding member according to claim 3, which is a separation pad.

5. The sheet feeding member according to claim 3, which is a sheet feed roller.

6. The sheet feeding member according to claim 1, which is a separation pad.

7. The sheet feeding member according to claim 6, wherein the separation pad has a surface having a rubber hardness of not less than 70 and not greater than 95 as expressed as a JIS-A hardness.

8. The sheet feeding member according to claim 7, wherein the separation pad has a surface having a friction coefficient of not less than 0.6 and not greater than 1.4.

9. A sheet feeding member comprising a thermoplastic elastomer composition which comprises:

a base polymer including 40 to 60 parts by mass of a polyurethane thermoplastic elastomer and 60 to 40 parts by mass of a polyester thermoplastic elastomer; and at least one ion conductive agent selected from the group consisting of a quaternary ammonium salt and a lithium salt/polyol, wherein the base polymer provides:

(a) a sea-island structure in which particles of the polyester thermoplastic elastomer are finely dispersed in the polyurethane thermoplastic elastomer, or (b) a sea-island structure in which particles of the polyurethane thermoplastic elastomer are finely dispersed in the polyester thermoplastic elastomer, wherein the ion conductive agent is present in a proportion of not less than 0.2 parts by mass and not greater than 4 parts by mass based on 100 parts by mass of the base polymer in the thermoplastic elastomer composition.

* * * * *